US007024805B2

(12) United States Patent
Onsager et al.

(10) Patent No.: US 7,024,805 B2
(45) Date of Patent: Apr. 11, 2006

(54) DRAGLINE EXCAVATING MACHINE WITH DIRECT DRIVE HOIST AND DRAG DRUMS

(75) Inventors: Michael G. Onsager, Franklin, WI (US); Carl D. Gilmore, South Milwaukee, WI (US); Walter Koellner, Suwanee, GA (US)

(73) Assignee: Bucyrus International, Inc., South Milwaukee, WI (US)

( * ) Notice: Subject to any disclaimer, the term of this patent is extended or adjusted under 35 U.S.C. 154(b) by 280 days.

(21) Appl. No.: 10/621,644

(22) Filed: Jul. 17, 2003

(65) Prior Publication Data

US 2004/0055185 A1 Mar. 25, 2004

Related U.S. Application Data

(60) Provisional application No. 60/396,842, filed on Jul. 18, 2002.

(51) Int. Cl.
*E02F 3/50* (2006.01)

(52) U.S. Cl. ..... 37/396; 37/401; 701/50; 318/803

(58) Field of Classification Search ..... 37/394, 37/395, 396, 397, 398, 399, 400, 401; 701/50; 318/3, 11, 12, 13, 803

See application file for complete search history.

(56) References Cited

U.S. PATENT DOCUMENTS

| | | | | | |
|---|---|---|---|---|---|
| 4,174,579 | A | * | 11/1979 | Learmont | 37/395 |
| 4,368,521 | A | * | 1/1983 | Sholes, II | 701/50 |
| 4,787,021 | A | * | 11/1988 | Hokari et al. | 363/37 |
| 5,963,020 | A | * | 10/1999 | Orr | 322/29 |

OTHER PUBLICATIONS

G.M. Brown, et al., Increased Productivity of AC Drives for Mining Excavators and Haul Trucks, pp. 1-10, Oct. 9, 2000.
W. Koellner, et al., "AC Drive System with Active Front End (AFE) for Mining Excavators," pp. 1-9, May 1, 2001.
Siemens, Active Front End—Simovert Masterdrives, pp. 1-10, Sep., 1997.
Siemens, A New Generation of Gearless Drives for the Ore Industry, Solutions for Metals, Mining, and More, pp. 1-18, Mar., 1997.

* cited by examiner

*Primary Examiner*—Thomas A Beach
(74) *Attorney, Agent, or Firm*—Quarles & Brady LLP

(57) ABSTRACT

A dragline excavating machine includes a gearless direct drive AC drive motor for driving each of the hoist and the drag drums in the system. The gearless AC motor is driven using a digital system which receives AC power from the utility system rectifies the power using active front end circuits, and converts the resultant DC to a frequency controlled AC using an inverter circuit. The resultant AC signal is employed to drive the gearless AC motor, resulting in reduced harmonic distortion, unity or leading power factor, and increased efficiency, reduced operating costs, and reduced mean time between failure.

20 Claims, 10 Drawing Sheets

DRAGLINE EXCAVATING MACHINE WITH DIRECT DRIVE HOIST AND DRAG DRUMS

CROSS-REFERENCE TO RELATED APPLICATIONS

This application claims the benefit of U.S. Provisional patent application Ser. No. 60/396,842 filed on Jul. 18, 2002 and entitled "Dragline Excavating Machine with Direct Drive Hoist and Dragline Drums".

BACKGROUND

The present invention is related to excavating machines, and more particularly to excavating machines with improved motor control systems for controlling the drag and hoist drums.

A dragline is an earth working or excavating machine used in mining operations such as the extraction of coal, iron, copper or other minerals or materials. A typical dragline excavating machine includes a machinery house mounted on a platform supported for rotation. Extending from the machinery house is a boom supported by cables or lines, and held at a desired angle of inclination by pendants extending from the boom to a gantry mounted on top of the machinery house. A bucket is suspended from the boom by hoist ropes wound on hoist drums in the machinery house, and can be dragged toward the dragline excavating machine by coordinated motion of the hoist ropes and drag ropes. The drag ropes are wound on drums also housed in the machinery house. The machinery house includes drive systems for driving the hoist and drag motors, "swing" motors for rotating the machinery house, and, for moving or walking dragline excavating machines, drive systems for controlling the shoes and walking mechanism or for controlling a crawling device.

At excavation sites, alternating current (AC) utility power lines are typically provided to provide power for excavating equipment including the dragline excavating machines used at the site. The hoist and drag drums in the dragline, however, are very large, and draw a significant amount of power from the utility lines when in use. The drive systems for driving the hoist and drag drums, therefore, must be selected to provide sufficient power to drive the drums, and also must be selected to limit the effects on the AC utility power system, including harmonic distortion and power factor problems. Furthermore, to adequately provide excavation processes, it is important to be able to drive the drums at a very low speed.

Because of these problems, the drag and hoist drums of typical dragline excavators are operated by DC motors and associated motor-generator sets connected to the AC power line. The motor-generator sets each include a large synchronous AC motor driving DC generators, and are typically arranged in Ward-Leonard loop configurations in which the large synchronous motors are capable of controlling power factor to minimize power system effects.

While generally successful in powering dragline excavators with minimal effect on the power supply, there are a number of disadvantages associated with the motor-generator sets typically employed in these systems. First, because of the amount of force required to drive the drums, multiple drive motors must be provided for each drum. These motors require a significant amount of space in the machinery house, and further require a significant amount of maintenance.

Furthermore, to drive the drums at a sufficiently low speed, the DC drive motors are coupled to the drums through very large gear trains extending, in some cases, over 25 feet. These large gear trains also require a significant amount of space in the machinery housing, and further, are difficult to align accurately. The production and maintenance of such gear trains, is, therefore, both difficult and expensive, adding significantly to the cost and size of the resultant dragline excavator.

Because of these issues, since around 1980, more efficient AC drives have also been applied in mining excavator applications. These AC drives, however, typically use SCR rectifiers, and therefore suffer from high harmonic distortion and relatively low power factor. Because these devices have a significant detrimental effect on the AC utility power supply which can affect other devices using the utility power, AC drives have not been applied successfully to large dragline excavators.

There remains a need, therefore, for an improved system for controlling the drag and hoist drums in a dragline excavating machine, and particularly for an improved system which reduces the number of parts, decreases maintenance requirements, reduces the size of the equipment, provides increased machine productivity, reduces energy consumption, and simplifies manufacturing.

SUMMARY OF THE INVENTION

The present invention provides an excavating machine comprising a bucket, and at least one rope coupled to the bucket for raising and lowering the bucket. A drum is coupled to an end of the rope, and a rotor of a ring motor is coupled directly to the drum. An AC inverter drive system is electrically connected to the ring motor to rotate the rotor in the ring motor. As the drum is rotated, the rope and associated bucket are moved to provide an excavating operation.

In another aspect, the invention provides an excavating machine including a machinery housing. A hoist drum in the machinery house is coupled to a hoist rope, and a drag drum in the machinery house is coupled to the drag rope. A gearless ring hoist motor is coupled directly to the hoist drum to drive the hoist drum, and a gearless ring drag motor is coupled directly to the drag drum to drive the drag drum, such that the drag drum and the hoist drum work together to extend or retract the bucket. A variable speed AC drive system is coupled to each of the hoist and drag drums to effect movement of bucket for an excavating operation.

The AC drive system can include active front end rectifiers for rectifying AC input power and frequency-modulated inverter control for controlling the hoist and drag motors. The active front end rectifiers provide a controllable power factor.

In yet another aspect, the present invention provides an excavating machine, comprising a variable speed AC drive with an active front end. A ring motor is electrically coupled to the variable speed AC drive, and a drum is coupled to the rotor of the ring motor. A rope is coupled at a first end to a digging element and at a second end to the drum, wherein the variable speed drive selectively activates the ring motor to rotate the rotor such that the drum rotates to move the rope and the digging element to effect a digging operation.

These and other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
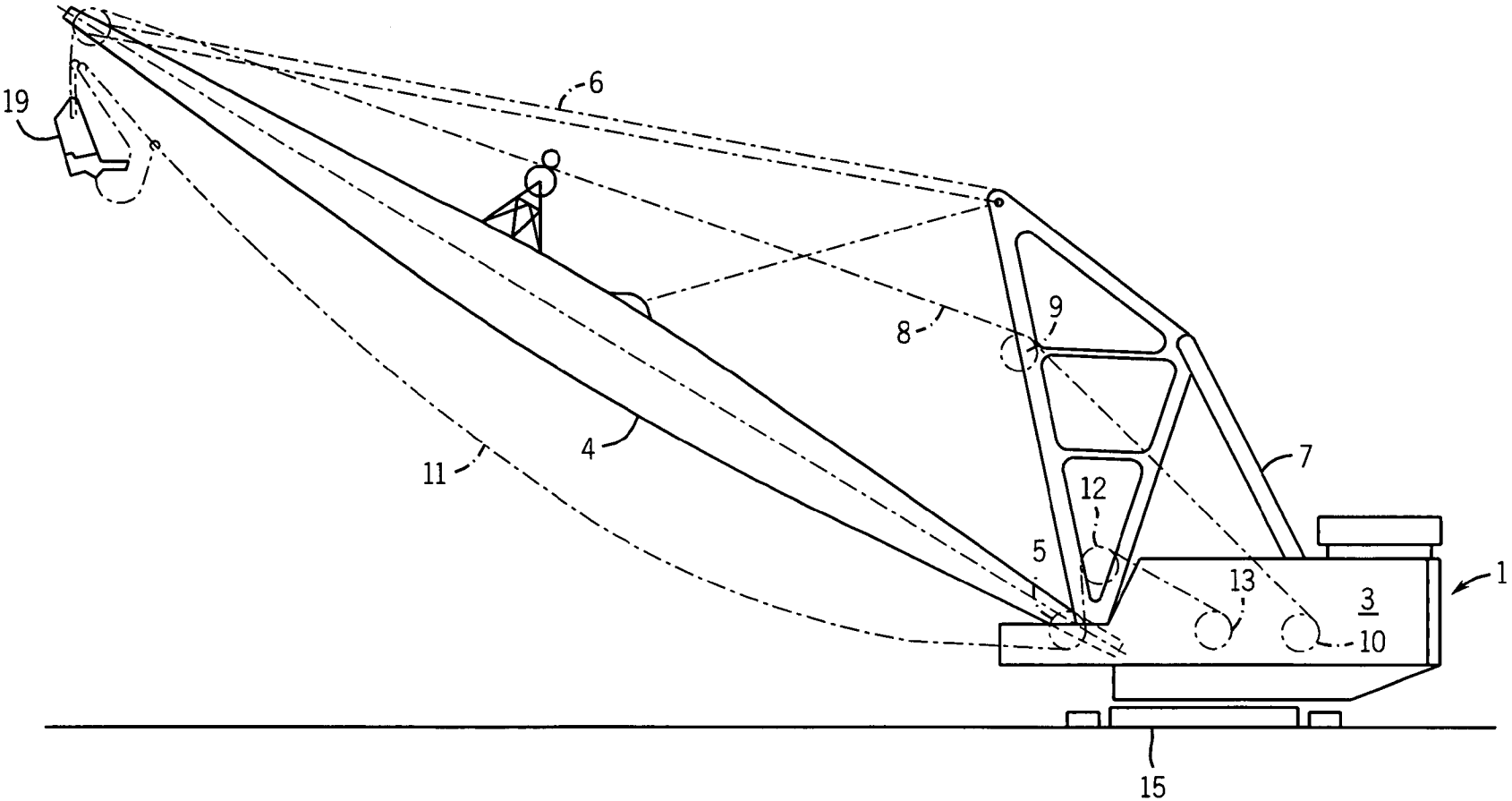
FIG. 1 is a perspective view of a moving or walking dragline excavating machine.

Referring now to the figures, and more particularly to FIG. 1, a portion of a dragline excavating machine 1 is shown. The machine consists of a base 2, which rests upon the ground and supports machinery house 3. The machinery house 3 has a boom 4 projecting upwardly from the lower front of the house 3, the boom 4 having its foot connected to the house by foot pins 5. The boom is held at the desired angle of inclination by means of pendants 6 extending from the boom to a gantry 7 mounted on top of the house 3. A bucket 19 is suspended by hoist ropes 8 which pass over sheaves 9 on the gantry legs to wind on hoist drums 10 in the house. The bucket is dragged toward the dragline excavating machine 1 by drag ropes 11 passing over fairleads 12 near the boom foot pins 5 and onto drag drums 13 in the machinery house 3. The house 3 is rotatably supported on a base by means of a roller circle (not shown). The machine is mounted on a walking shoe or walking mechanism 15, which allows the dragline excavating machine to be moved from place to place. The walking mechanism 15 includes a shoe 16 that is driven internally by a drive systems 17 including an internal motor and gear assembly 18, in a conventional manner. Although the system will be described as a dragline excavating machine throughout the specification, the technology described can also be provided in other walking or moving excavating machines, and particularly in mining shovels.

Figure 2:
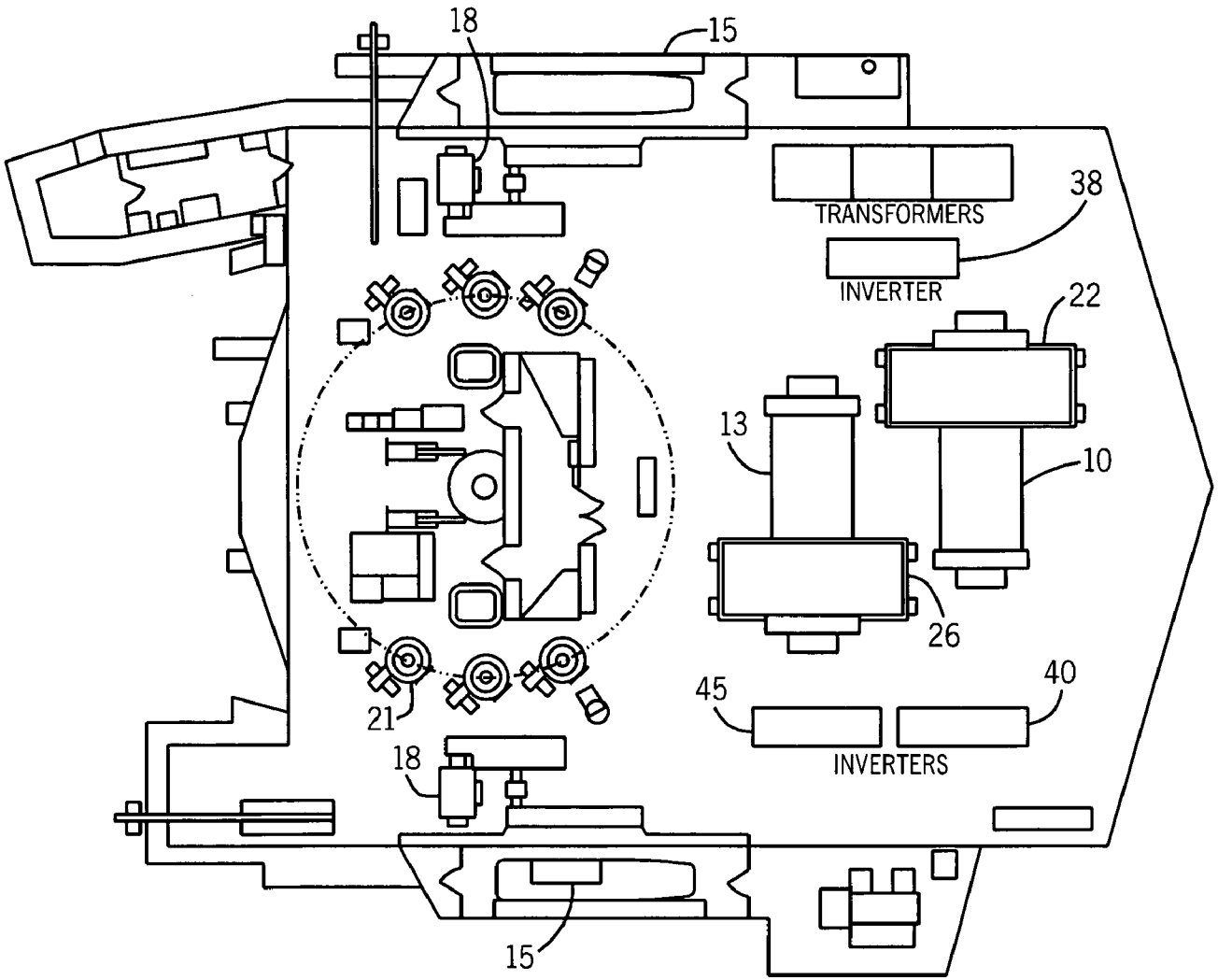
FIG. 2 is a top view of the components provided on a floor of the machinery house of FIG. 1.

Referring now to FIG. 2 a preferred embodiment of a machinery housing 3 constructed in accordance with the present invention is shown. Mounted to the floor of the housing 3 are drive systems for each of the walking mechanisms 15, the hoist drum 10, the drag drum 13, and associated swing motors 21. In this embodiment, the hoist 10 and drag drums 13 are each connected to a single ring motor 22 and 26 driven by a variable speed AC drive or "inverter", 38 and 40, respectively. An additional inverter 45 is provided to operate the swing motors 21, and the walk motors 18 controlling the walking mechanism 15. As the swing motors 21 and walk motors 18 are not operated at the same time, a single inverter 45 can control each of these functions, thereby decreasing the number parts used in the excavating machine. The inverters 38, 40, and 45 are variable speed AC drives capable of driving motors at very low speeds with minimal effect on power factor and minimal harmonic distortion in the distribution system, and therefore allow for efficient, low speed control of the motors, as described below. Although a single inverter 38, 40, and 45 is shown, a plurality of invertors can be used in each drive. Furthermore, although a single drive motor is shown for each drum 10 and 13, two motors could also be used, as described below.

Each of the hoist and drag motors 22 and 26 are gearless wrap-around or ring motors. The gearless wrap-around or ring motors are very low speed AC synchronous or asynchronous motors which, referring now also to FIG. 3, can be coupled directly to the respective drum, thereby eliminating the need for gear trains to power the drums 10 and 13. Similar gearless wraparound or ring motors have been used in grinding mill, conveyor, and mine winding applications and are available commercially, for example, from Siemens AG of Erlangen, Germany.

Figure 3A:
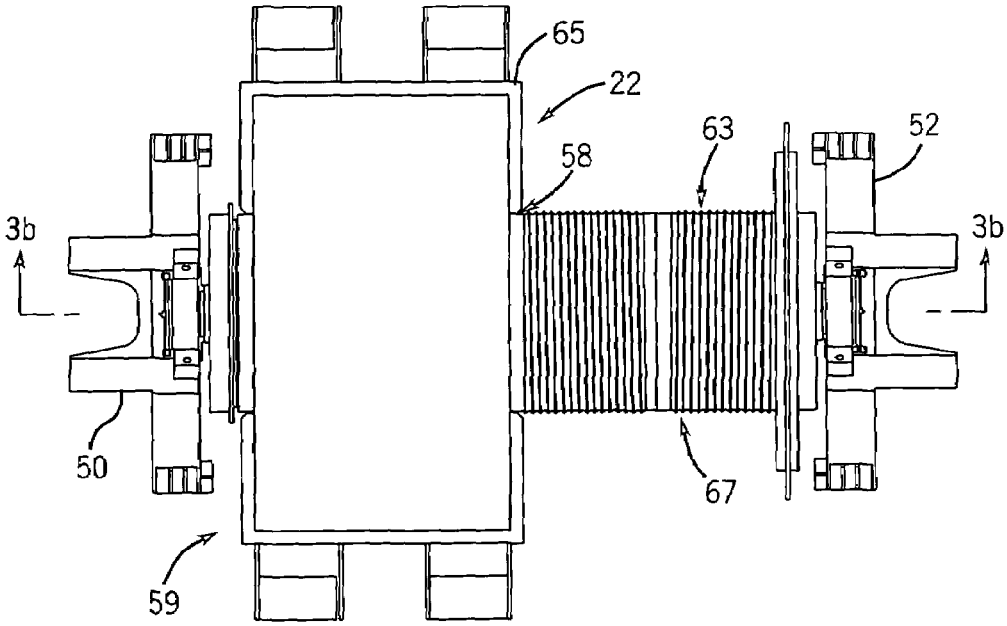
FIG. 3*a* is a top view of a hoist or drag drum coupled to a direct drive ring motor.
Figure 3B:
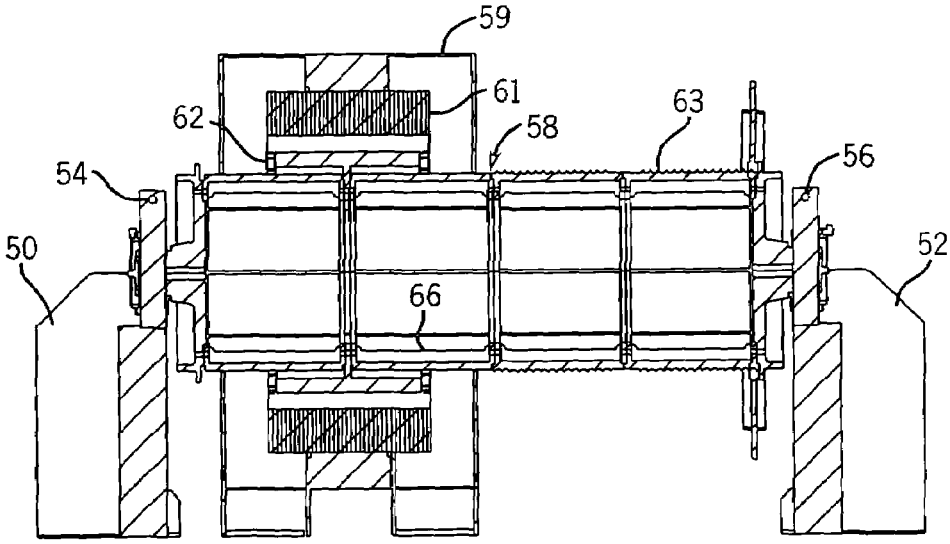
FIG. 3*b* is a side cutaway view of the hoist or drag drum of FIG. 3*a* taken along the line 3*b*—3*b*.
Figure 3C:
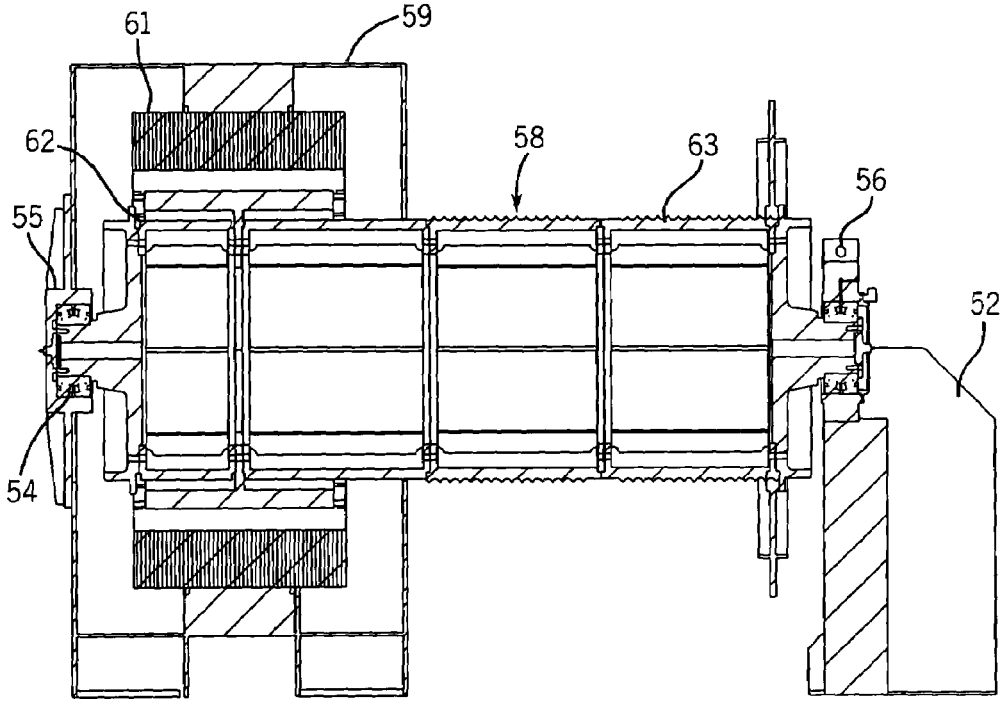
FIG. 3*c* is a side cutaway view of an alternate embodiment of a hoist or drag drum coupled to a direct drive ring motor.

Referring now to FIGS. 3*a* and 3*b*, a top view and a cutaway view of a hoist or drag motor 22 or 26 are shown, respectively. Referring first to FIG. 3*a*, as described above, the hoist and drag motors 22 or 26 are AC wraparound or ring motors, and each comprise a spool 58 extending through the center of a ring-shaped section 59. Referring now to FIG. 3*b*, the spool 58 includes a rotor portion 60 which is substantially centered in the ring-shaped section 59 and carries rotor poles 62 for the case of a synchronous motor, or as squirrel cage in the case of an induction motor, adjacent a stator winding 61 mounted in the ring-shaped section 59. A drum portion 63, which can be either the hoist drum 10 or drag drum 13 is coupled directly to the rotor portion 60, and rotates with the rotor portion 60, as described below. The ring-shaped section 59 and associated rotor portion 60 are housed in an outer housing 65 which is mounted to the floor of the machinery house 3. The spool 58 is further coupled through bearings 54 and 56 to vertical supports 50 and 52, which are also mounted to the floor of the machinery housing 3. Referring now to FIG. 3*c*, in an alternative construction, the bearing 54 is mounted to an outer end plate 55 of the motor, eliminating the vertical support 50 on that end of the drum 10 or 13. Grooves 67 are provided in the drum 63 for receiving a rope for pulling a bucket or other mining implement.

Figure 4:
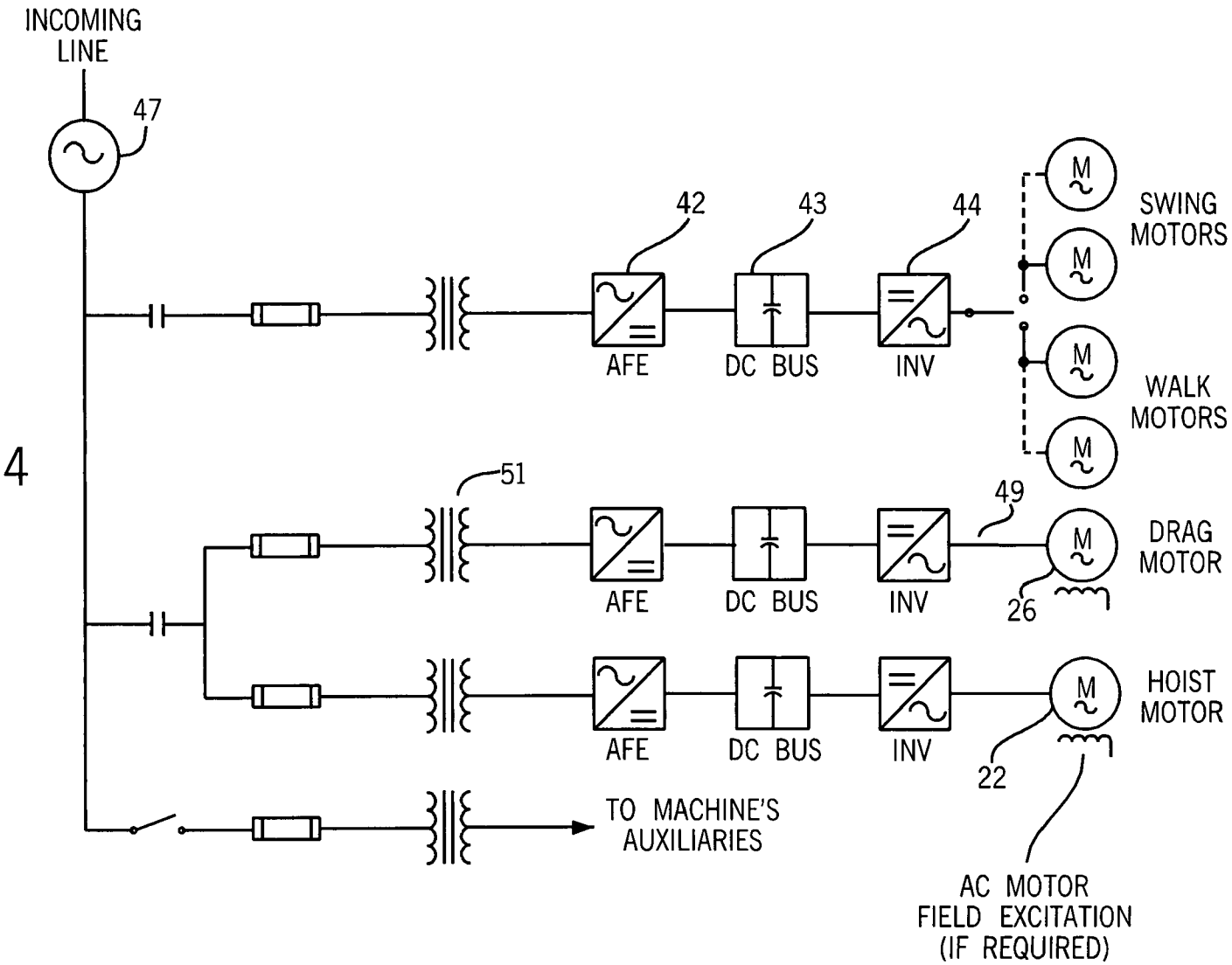
FIG. 4 is a typical circuit diagram including both an active front end and inverter circuit for driving the direct drive motors.
Figure 5:
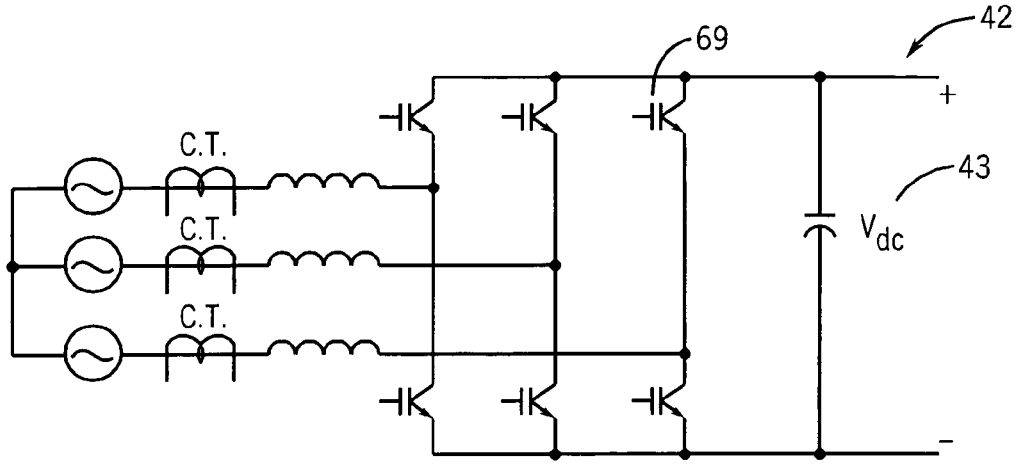
FIG. 5 is a circuit diagram of an Insulated Gate Bipolar Transistor (IGBT) Active Front End (AFE) circuit.

Referring now FIG. 4, a block circuit diagram of the power system of the dragline and inverters 38 and 40 is shown. Input power is provided by an AC utility line 47 which is provided through a transformer 51 (FIGS. 2 and 4). The inverters 38 and 40 are very low speed, variable speed AC drives capable of operating in a range of twenty hertz or less. These variable speed drives preferably include active front end (AFE) rectifiers 42 for converting the AC utility power supply 47 to a direct current (DC) voltage 43, and an inverter circuit 44 for converting the DC voltage 43 to a frequency-controlled AC signal 49 for driving the motor 22 or 26. Referring now to FIG. 5, as noted above, these drives typically utilize power switching devices 69 such as IGBT (insulated gate bipolar transistor) or IGCT (integrated gate commutated transistors) or IEGT (injection enhanced gate transistor) technology both in the AFE rectifier 42 and in the inverters 44. In the AFE rectifier 42, this technology allows the drive to control power factors appropriately for use in the dragline while generating a relatively low level of harmonics. In the inverter 44, this technology provides a variable voltage/variable frequency source to power and control the wraparound or ring motors 22 and 26 efficiently and at very low speeds with significant resolution.

Figure 6:
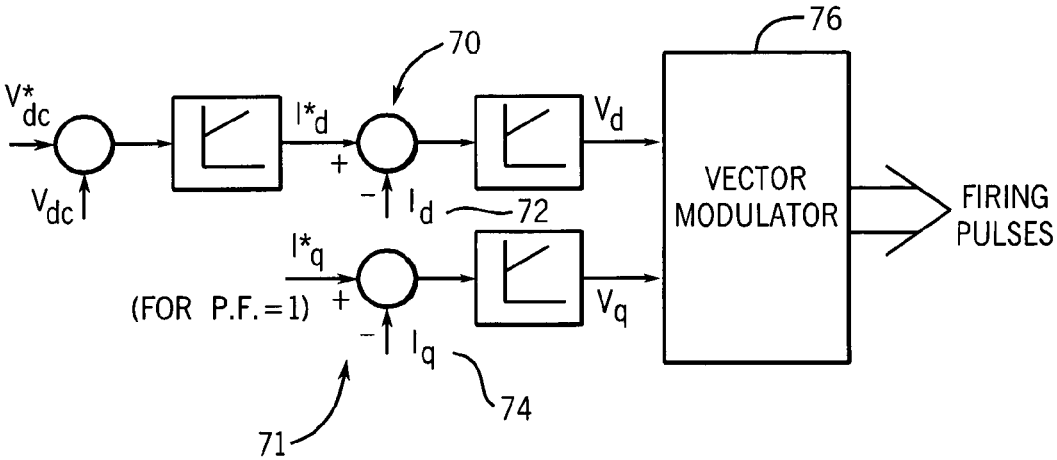
FIG. 6 is a flow diagram illustrating a control circuit for the IGBT AFE circuit of FIG. 5.
Figure 7:
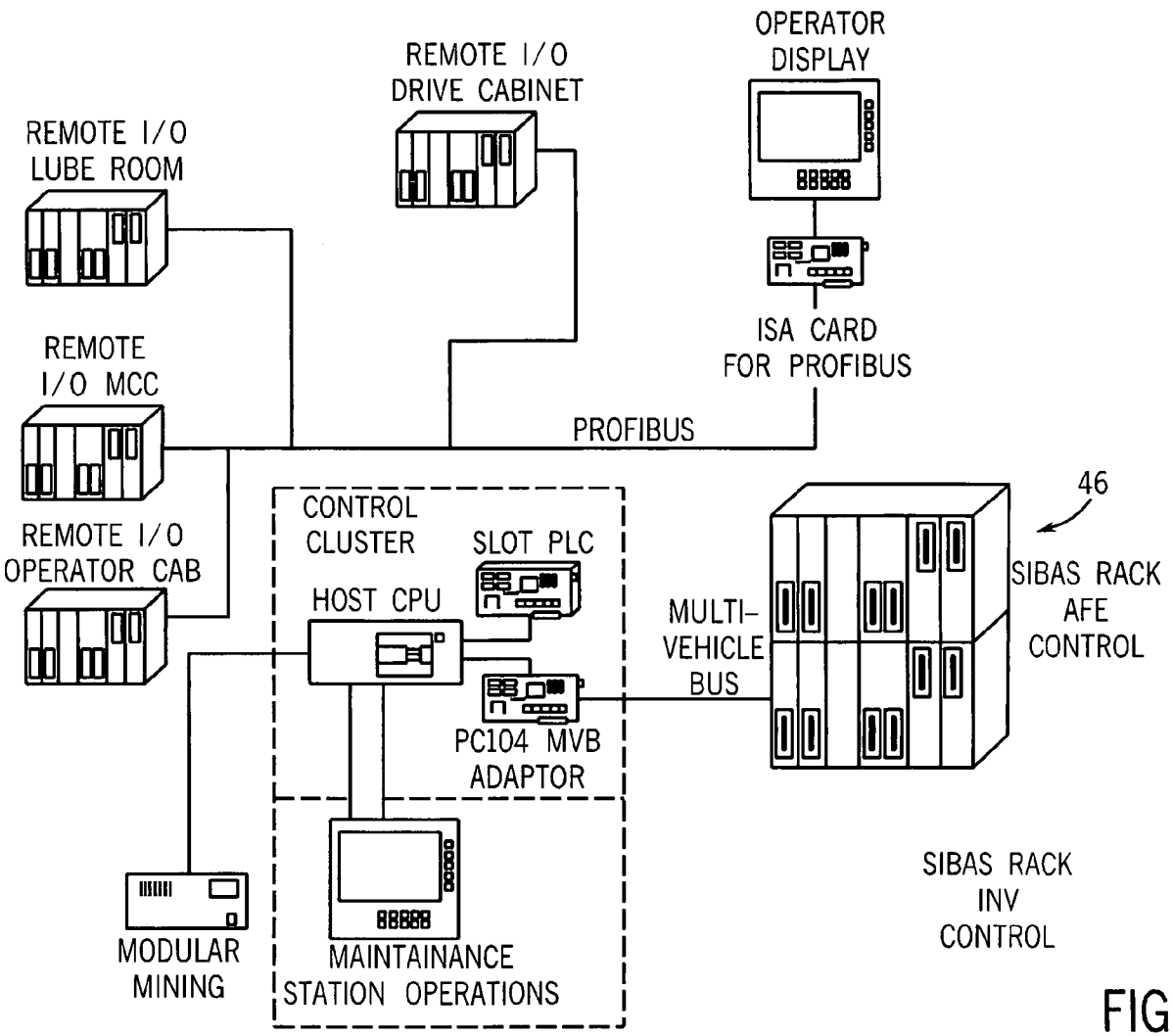
FIG. 7 is a block diagram of control circuit components and communication network for a dragline mining system.
Figure 8:
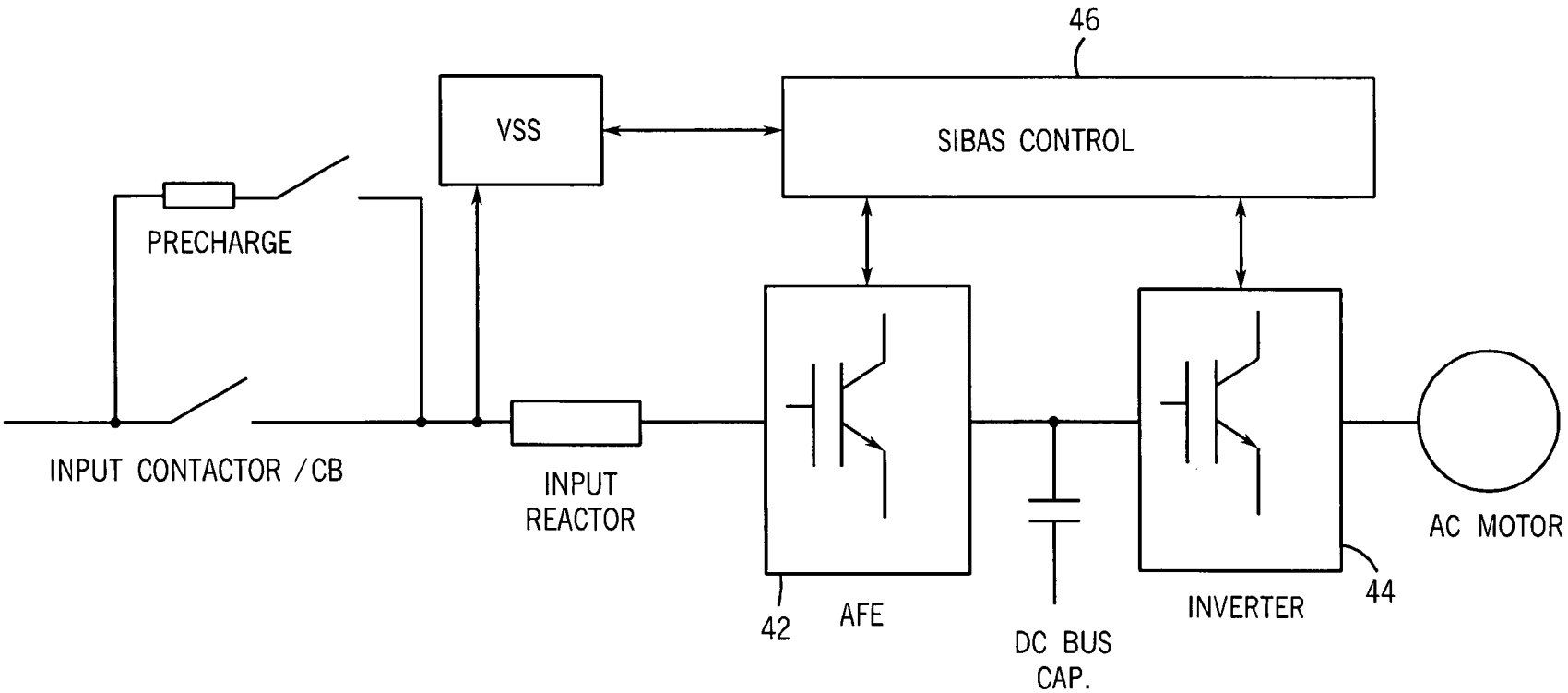
FIG. 8 is a block diagram of the IGBT AFE and Inverter circuits as controlled by the controller of FIG. 7.

Referring now to FIGS. 6 and 7, a closed loop control is used to regulate the output voltage VDC of each of the AFE circuits 42 by maintaining the balance of active power through the circuit using feedback loops 70 and 71 to control the active current $I_d$ 72 and the reactive current $I_q$ 74. A vector modulator 76 is used to generate the firing pulses for the power transistors in the AFE circuit 42 and, as a result of this control, the AFE circuit 42 controls the power factor without additional capacitors or passive filters. The AFE is preferably designed to operate with power factor PF=1. If required, a leading power factor of up to 0.8 leading can be adjusted. Referring now also to FIG. 8, the control of the AFE rectification and inverter circuits 44 can be provided by a central controller 46 which provides firing signals for all of the IGBT circuits and which can also be tied through communications links to various other operating stations in the machine to provide maintenance and other functions. Although variable speed drives as described above can be built specifically for the application, suitable variable speed AC drives are commercially available for instance from Siemens AG of Erlangen Germany, sold under trade names such as Simovert® Masterdrives, Simovert® ML, Transvektor® controls, and other brand names. Although commercially available, typically, these drives are built and sized for a specific application.

Figure 9:
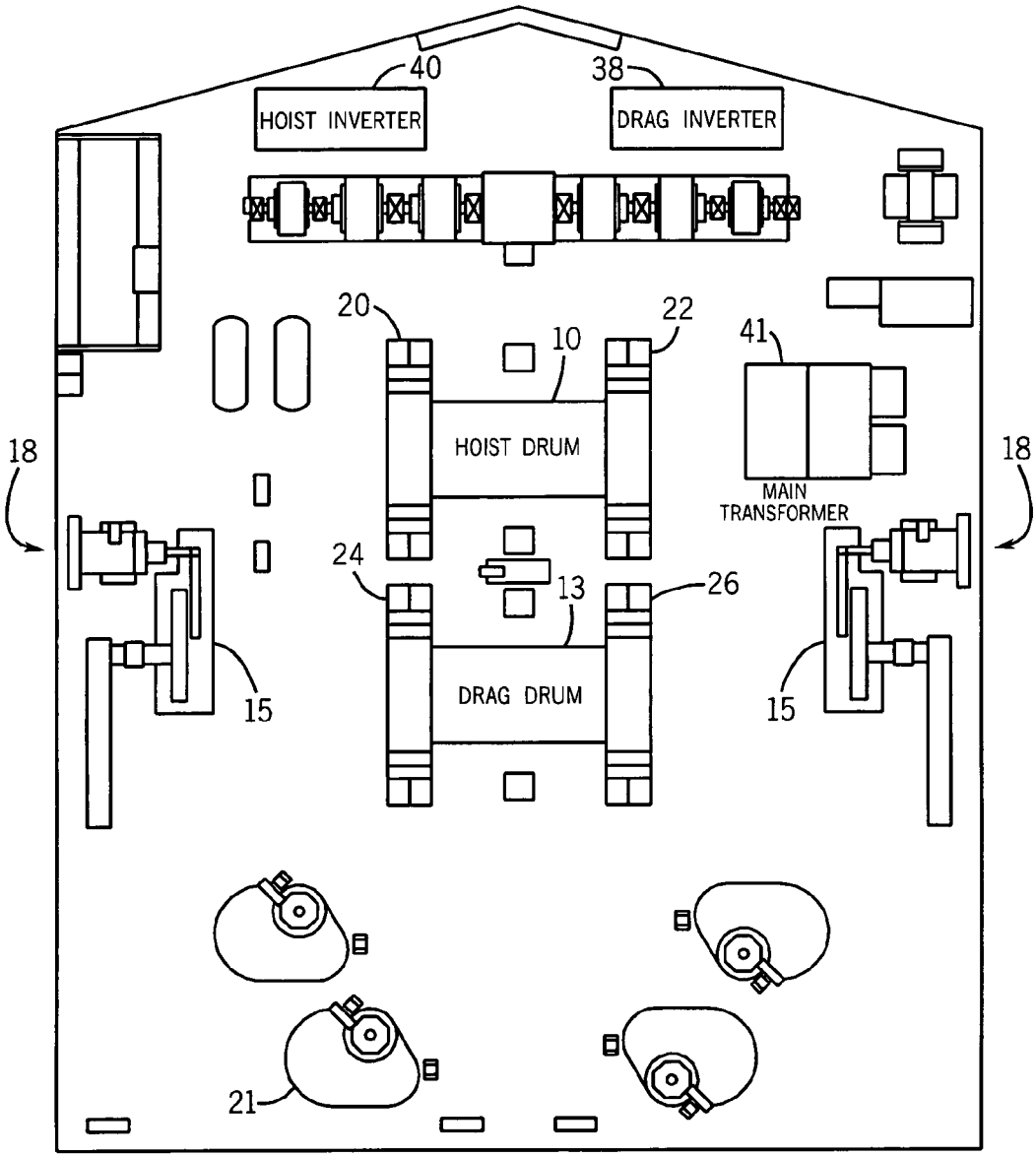
FIG. 9 is a top view of the components provided on a floor of the machinery house of FIG. 1 in a second embodiment of the invention.
Figure 10:
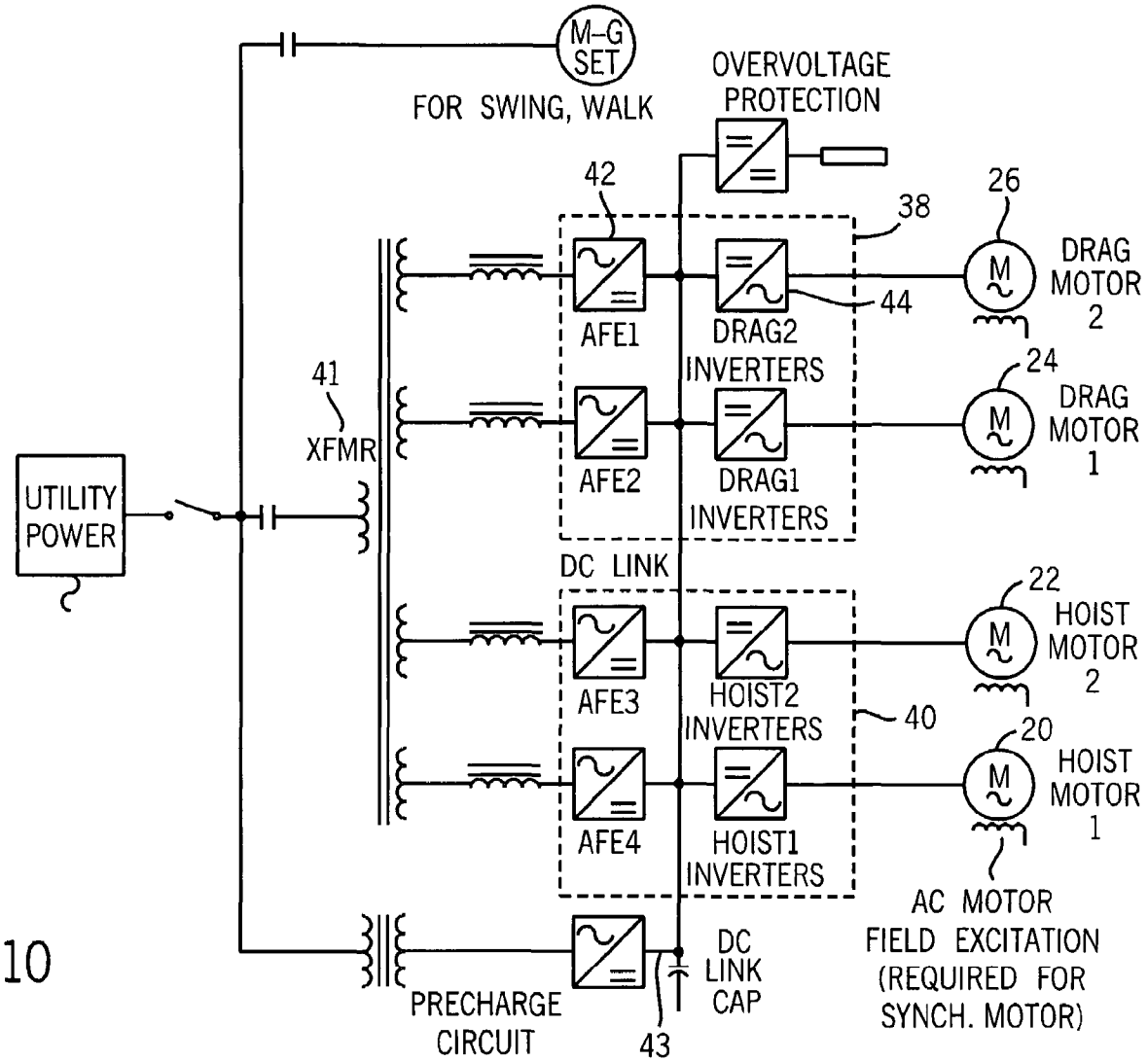
FIG. 10 is a block diagram of a control circuit for a dragline making system as shown in FIG. 9.

Referring now to FIGS. 9 and 10, a second embodiment of a floor of a machinery house 3 and associated control circuitry constructed in accordance with the present invention is shown, with components mounted providing drive systems for each of the walking mechanisms 15, the hoist drums 10 and drag drums 13, and associated swing motors. Here, each of the drums 10 and 13 are driven by one or two motors. The hoist drums 10 are driven by first and second hoist motors 20 and 22, while the drag drums 13 are driven by first and second drag motors 24 and 26. Each of the inverters 38 and 40 include first and second AFE rectifiers 42 and first and second inverter circuits 44, providing one AFE rectifier 42 and one inverter circuit 44 for each motor 20, 22, 24, and 16. Here, motor-generator sets are provided for driving the swing motors 21 and the crawler motors 18. Although a machinery house 3 as shown in FIG. 9 could be provided in a new excavating machine, this embodiment illustrates a method of retrofitting an existing excavating machine with hoist and drag motors 22 and 26 and inverters 38 and 40 as described above. Although the motor-generator sets could be removed and replaced with an inverter 45 to drive the swing motors 21 and walk motors 18, here the motor-generator sets have been retained to limit the cost of a retrofit. Various other methods of retrofitting existing dragline systems will be apparent, and those configurations can be provided in both one and two motor drive configurations.

Referring again to FIG. 2, in operation, the inverters 38 and 40 receive power from the utility line 47 through a transformer 51, and convert the power to a voltage and frequency controlled signal to drive the ring motors 22 and 26. As the motors 22 and 26 are rotated, the rotor portions 60 directly rotate the hoist drum 10 and drag drum 13, respectively. The present invention therefore provides a gearless drive for directly driving both the hoist drum 10 and drag drum 13, eliminating the large and expensive gear trains found in prior art dragline or other excavating machines. The elimination of the gear trains found in prior art devices significantly reduces the size and complexity of the machinery house, reduces maintenance functions such as lubrication, and simplifies the manufacturing of the dragline. Furthermore, the construction of the present invention significantly reduces the mean time between failure, and significantly reduces the cost of replacement parts for gears and other parts subject to wear during use.

Furthermore, the use of the variable speed AC drive system with active front end reduces power factor and harmonic distortion issues associated with prior art systems, and further provides a more efficient control system which is more reliable and has a longer mean time between failure. The power transistor switching circuits, furthermore, have a high overload capacity which further eliminates the need for protective circuits for the rectifiers and inverters in the drive system. The drive system can operate at a unity (or better) power factor and less than 8% total harmonic distortion. Furthermore, total efficiency of the system has been shown to be up to 20% higher than that of prior art DC drives.

Additionally, the present invention significantly reduces the number of (and preferably completely eliminates) DC motor-generator sets, thereby reducing the number of components required in the dragline excavating machine, reducing maintenance, mean time between failure, manufacturing complexity, the number of spare parts required for maintenance, and the overall size of the drive system for the dragline. The reduction in motors and gear train components, in fact, allows the system to be provided in the same deck footprint as prior art systems despite larger motor configurations. As the wraparound gearless or ring motors used in the system do not use the brushes and commutators found in DC systems, the AC motor systems further require less maintenance than prior art DC systems.

Furthermore, the digital control system employed in the dragline excavating machine can be connected to an overall control system, providing easy access to maintenance and operational information, and allowing the dragline system to be tied to other components in an excavating operation to provide overall control of an excavating operation.

Additionally, replacing the gearing and DC motor-generator sets with gearless ring motors and associated AC variable speed drives improves the speed and resolution of bucket movements resulting in increased productivity. Use of the gearless drive system of the present invention results in reduced bucket filling times, higher hoisting speeds, and greater efficiency. Furthermore, these productivity increases can be achieved while reducing energy consumption.

Although the system has been described with reference to a dragline excavating machine, the described technology could be applied to other walking and moving excavating machines as well. For example, the system described can be provided also in a mining shovel application.

The invention has been described in detail with particular reference to certain preferred embodiments thereof, but it will be understood that variations and modifications can be effected within the spirit and scope of the invention.

The invention claimed is:

1. An excavating machine comprising:

a bucket coupled to a hoist rope and to a drag rope;

a machinery housing, the machinery housing including:

a hoist drum coupled to the hoist rope;

a drag drum coupled to the drag rope;

a ring hoist motor coupled to the hoist drum to drive the hoist drum; and a ring drag motor coupled to the drag drum to drive the drag drum, the drag drum and the hoist drum working together to extend or retract the bucket; and a drag variable speed AC drive system electrically connected to the ring drag motor; and a hoist variable speed AC drive system electrically connected to the ring hoist motor, wherein the drag and hoist variable speed drives selectively rotate the hoist and drag drums, respectively, to effect a digging operation;

wherein at least one of the hoist drum and the drag drum is coupled to a rotor of the corresponding gearless ring hoist motor or gearless ring drag motor.

2. The excavating machine as defined in claim 1, further comprising a variable speed AC drive electrically connected to the hoist motor and the drag motor to drive the hoist and the drag motors.

3. The excavating machine as defined in claim 1, where the hoist motor and the drag motor are each ring motors.

4. The excavating machine as defined in claim 2, wherein the variable speed AC drive includes an active front end rectifier circuit.

5. The excavating machine as defined in claim 2, wherein the variable speed drive includes an inverter circuit comprising at least one of an Insulated Gate Bipolar Transistor (IGBT) switching circuit or an Integrated Commutating Gate Transistor (IGCT) switching circuit or an Injection Enhanced Gate Transistor (IEGT) switching circuit.

6. The excavating machine as defined in claim 2, wherein the AC variable speed drive comprises an AFE rectifier circuit for rectifying AC utility power to a DC signal and an inverter circuit for converting the DC signal to a frequency controlled signal for controlling the drag and hoist motors.

7. The excavating machine as defined in claim 6, wherein the AFE rectifier circuit and the inverter circuit each use power transistors driven by a digital controller to produce firing signals.

8. The excavating machine as defined in claim 7, wherein the power switching devices are at least one of an IGBT device, an IGCT device, or an IEGT device.

9. The excavating machine as defined in claim 1, wherein the ring hoist motor is integral with the hoist drum and the ring drag motor is integral with the drag drum.

10. An excavating machine, comprising:

a bucket;

at least one rope coupled to the bucket for raising and lowering the bucket;

a drum coupled to an end of the rope;

a ring motor having a rotor coupled to the drum; and an inverter drive system electrically connected to the ring motor to rotate the rotor in the ring motor, wherein as the rotor is rotated, the drum is rotated to move the rope to effect an excavation operation.

11. The excavating machine as defined in claim 10, wherein the ring motor comprises a ring-shaped stator circumventing the rotor.

12. The excavating machine as defined in claim 10, wherein the drum is configured to hoist the bucket.

13. The excavating machine as defined in claim 10, further comprising a second drum coupled to an end of a second rope and to the bucket, the second drum being configured to drag the bucket toward the excavating machine.

14. The excavating machine as defined in claim 10, wherein the inverter drive system is an active front end inverter.

15. The excavating machine as defined in claim 10, wherein the excavating machine is a dragline.

16. The excavating machine as defined in claim 10, wherein the excavating machine is a mining shovel.

17. The excavating machine as defined in claim 10, wherein the ring motor is integrated into the drum.

18. An excavating machine, comprising:

a variable speed AC drive;

a ring motor, electrically connected to the variable speed AC drive;

a drum coupled to the rotor of the ring motor;

a rope, coupled at a first end to a digging element and at a second end to the drum;

wherein the variable speed drive selectively activates the ring motor to rotate the rotor such that the drum rotates to move the rope and the digging element to effect a digging operation.

19. The excavating machine as defined in claim 18, wherein the variable speed drive comprise an inverter supply.

20. The excavating machine as defined in claim 18, wherein the variable speed drive comprises an active front end inverter.

* * * * *